US009104169B2

(12) United States Patent
Jang et al.

(10) Patent No.: US 9,104,169 B2
(45) Date of Patent: Aug. 11, 2015

(54) ELECTROPHOTOGRAPHIC IMAGE FORMING APPARATUS

(71) Applicant: SAMSUNG ELECTRONICS CO., LTD., Suwon (KR)

(72) Inventors: Ho-jin Jang, Suwon (KR); Young-chae Kim, Seoul (KR); Sang-jin Park, Hwaseong (KR); Ki-hyun Yoo, Suwon (KR); Sang-hoon Lee, Suwon (KR); Seung-gweon Lee, Suwon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/021,518

(22) Filed: Sep. 9, 2013

(65) Prior Publication Data

US 2014/0205315 A1 Jul. 24, 2014

Related U.S. Application Data

(60) Provisional application No. 61/756,269, filed on Jan. 24, 2013.

(30) Foreign Application Priority Data

Apr. 23, 2013 (KR) ..... 10-2013-0045043

(51) Int. Cl.
*G03G 21/16* (2006.01)
*G03G 21/18* (2006.01)

(52) U.S. Cl.
CPC ..... *G03G 21/1623* (2013.01); *G03G 21/1633* (2013.01); *G03G 21/1676* (2013.01); *G03G 21/1821* (2013.01)

(58) Field of Classification Search
CPC combination set(s) only.
See application file for complete search history.

(56) References Cited

U.S. PATENT DOCUMENTS

| | | | |
|---|---|---|---|
| 5,160,964 | A | 11/1992 | Takahashi et al. |
| 6,654,581 | B2 | 11/2003 | Liu et al. |
| 6,678,489 | B1 | 1/2004 | Carter et al. |
| 6,690,903 | B2 | 2/2004 | Okabe et al. |
| 6,873,810 | B2 | 3/2005 | Okabe et al. |
| 7,616,907 | B2 | 11/2009 | Kim et al. |

(Continued)

FOREIGN PATENT DOCUMENTS

| | | |
|---|---|---|
| EP | 1806634 A1 | 7/2007 |
| JP | 2009-181018 | 8/2009 |

(Continued)

OTHER PUBLICATIONS

Extended European Search Report mailed Jun. 12, 2014 in related European Application No. 13196416.5.

(Continued)

*Primary Examiner* — Clayton E Laballe
*Assistant Examiner* — Jas Sanghera
(74) *Attorney, Agent, or Firm* — Staas & Halsey LLP

(57) ABSTRACT

An electrophotographic image forming apparatus is provided including a body including an opening, a photoreceptor cartridge attached to, or detached from, the body through the opening and including a mounting portion, a development cartridge attached to, or detached from, the mounting portion through the opening when the photoreceptor cartridge is mounted in the body, and a cover opening or closing the opening and fixing the development cartridge to the mounting portion by pressurizing the development cartridge while the opening is closed.

16 Claims, 14 Drawing Sheets

(56) References Cited

U.S. PATENT DOCUMENTS

| | | | | |
|---|---|---|---|---|
| 8,121,518 | B2 | 2/2012 | Sato | |
| 8,457,525 | B2 | 6/2013 | Kamimura | |
| 2003/0049046 | A1 | 3/2003 | Okabe | |
| 2004/0096240 | A1 | 5/2004 | Kim | |
| 2005/0002682 | A1* | 1/2005 | Lyu et al. | 399/107 |
| 2005/0111881 | A1 | 5/2005 | Arimitsu et al. | |
| 2005/0191090 | A1* | 9/2005 | Nishimura | 399/113 |
| 2006/0257163 | A1* | 11/2006 | Sato | 399/111 |
| 2007/0071496 | A1 | 3/2007 | Lee | |
| 2007/0147887 | A1 | 6/2007 | Hattori | |
| 2009/0067877 | A1 | 3/2009 | Terai | |
| 2011/0064461 | A1 | 3/2011 | Ishii et al. | |
| 2011/0091222 | A1 | 4/2011 | Kim et al. | |
| 2011/0206410 | A1 | 8/2011 | Okabe | |
| 2011/0236060 | A1 | 9/2011 | Takagi | |
| 2014/0037330 | A1 | 2/2014 | Hiramatsu et al. | |

FOREIGN PATENT DOCUMENTS

| | | |
|---|---|---|
| JP | 2009-181027 | 8/2009 |
| JP | 2009-244555 | 10/2009 |
| JP | 2010-266893 | 11/2010 |
| JP | 2011-22616 | 2/2011 |
| JP | 2011-65185 | 3/2011 |
| JP | 4743199 | 5/2011 |
| JP | 2012-42725 | 3/2012 |
| KR | 10-2007-0087738 | 8/2007 |
| KR | 10-2011-0071440 | 6/2011 |
| KR | 10-1066103 | 9/2011 |

OTHER PUBLICATIONS

European Office Action mailed Apr. 29, 2014 in related European Application No. 1317061.9.

European Office Action mailed Apr. 28, 2014 in related European Application No. 13170028.8.

European Search Report mailed Sep. 4, 2013 in related European Application No. 13170028.8.

European Office Action mailed Sep. 30, 2013 in related European Application No. 13170028.8.

European Search Report mailed Sep. 4, 2013 in related European Application No. 13170061.9.

European Office Action mailed Sep. 30 in related European Application No. 13170061.9.

Office Action mailed Sep. 9, 2014 in related U.S. Appl. No. 14/029,172.

Office Action mailed Jul. 14, 2014 in related U.S. Appl. No. 13/906,582.

Office Action mailed Dec. 22, 2014 in related U.S. Appl. No. 14/014,626.

Office Action mailed Dec. 1, 2014 in related U.S. Appl. No. 13/906,587.

Notice of Allowance mailed Feb. 2, 2015 in related U.S. Appl. No. 14/029,172.

Notice of Allowance mailed Jan. 14, 2015 in related U.S. Appl. No. 13/906,582.

Korean Notice of Allowance mailed Sep. 22, 2014 in related Korean Application No. 10-2013-0045046.

Korean Notice of Allowance mailed Sep. 22, 2014 in related Korean Application No. 10-2013-0045047.

European Office Action mailed Oct. 30, 2014 in related European Application No. 13170061.9.

European Office Action dated May 5, 2015 in corresponding European Patent Application No. 13170061.9.

European Office Action dated Mar. 10, 2015 in corresponding European Patent Application No. 13170028.8.

U.S. Final Office Action mailed Jun. 18, 2015 in co-pending U.S. Appl. No. 13/906,587.

* cited by examiner

ELECTROPHOTOGRAPHIC IMAGE FORMING APPARATUS

CROSS-REFERENCE TO RELATED APPLICATIONS

This application is related to, and claims priority to, U.S. Provisional Application No. 61/756,269, filed on Jan. 24, 2013, and Korean Patent Application No. 10-2013-0045043, filed on Apr. 23, 2013, in the Korean Intellectual Property Office, the disclosures of which are incorporated herein in their entirety by reference.

BACKGROUND

1. Field

Exemplary embodiments of the present invention relate to an electrophotographic image forming apparatus capable of attaching/detaching a process cartridge.

2. Description of the Related Art

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

A process cartridge is an assembly of components for forming a visible toner image, and is a consumable product that may be detachable from a body of an image forming apparatus and replaceable after a life is ended. An integrated process cartridge includes a photoreceptor and contains toner to be supplied to the photoreceptor. However, an amount (life) of toner contained in the integrated process cartridge may be shorter than a life of the photoreceptor. Since a life of the integrated process cartridge may be dependent upon the amount of toner contained therein, after the toner is all used up, the integrated process cartridge may have to be replaced even if the life of the photoreceptor is not expired, thereby increasing consumable product costs for a user.

In order to reduce consumable product costs, a separable process cartridge may be desired so that a photoreceptor cartridge including a photoreceptor and a development cartridge containing toner are individually replaced.

SUMMARY

Additional aspects and/or advantages will be set forth in part in the description which follows and, in part, will be apparent from the description, or may be learned by practice of the invention.

Exemplary embodiments of the present general invention provide an electrophotographic image forming apparatus capable of individually attaching/detaching a photoreceptor cartridge and a development cartridge to/from a body and having improved user convenience.

According to an aspect of the present invention, an electrophotographic image forming apparatus is provided including a body including an opening, a photoreceptor cartridge attached to, or detached from, the body through the opening and including a mounting portion, a development cartridge attached to, or detached from, the mounting portion through the opening in a state where the photoreceptor cartridge is mounted in the body, and a cover opening or closing the opening, and including a pressurization portion for fixing the development cartridge to the mounting portion by pressurizing the development cartridge while the opening is closed.

The photoreceptor cartridge may include a photoreceptor on which an electrostatic latent image is formed, and mounting and removal directions of the photoreceptor cartridge and the development cartridge may be a traverse direction crossing a length direction of the photoreceptor at right angles.

The mounting portion may include first and second guide members respectively extending from both side portions of the photoreceptor cartridge towards the opening to support both side portions of the development cartridge.

The mounting portion may include guide rails provided at each of the first and second guide members, and first and second accommodation portions, wherein first and second guide protrusions guided by the guide rails and respectively accommodated in the first and second accommodation portions may be provided respectively at the both side portions of the development cartridge.

The guide rails may include a first guide rail for guiding the first guide protrusion to the first accommodation portion, and a second guide rail for guiding the second guide protrusion to the second accommodation portion by being branched from the first guide rail.

A protrusion amount of the second guide protrusion from both side walls of the development cartridge may be smaller than a protrusion amount of the first guide protrusion, the first and second guide rails may each have a rib shape respectively protruding from inner walls of the first and second guide members, and a protrusion amount of the first guide rail from the inner wall may be smaller than a protrusion amount of the second guide rail near a branching location of the second guide rail.

The electrophotographic image forming apparatus may include a first handle provided at the photoreceptor cartridge, and a second handle provided at the development cartridge, wherein the second handle may further protrude towards the opening than the first handle.

The second handle may include a top surface and a bottom surface, wherein the top surface may include a recessed portion partially recessed downward.

A display member having a color different from a portion of the development cartridge may be provided at the recessed portion.

A rear edge of the second handle may protrude from the bottom surface.

An uneven pattern may be formed on the bottom surface.

The electrophotographic image forming apparatus may further include, a first handle provided at the photoreceptor cartridge; and a second handle provided at the development cartridge, wherein the second handle may be located above the first handle.

According to another aspect of the present general inventive concept, there is provided an electrophotographic image forming apparatus including, a body including an opening; a photoreceptor cartridge attached to, or detached from, the body through the opening, and including a first handle and a mounting portion, and a development cartridge including a second handle and attached to, or detached from, the mounting portion through the opening in a state where the photoreceptor cartridge is mounted in the body, wherein the second handle may protrude further towards the opening than the first handle.

The second handle may be located above the first handle.

The photoreceptor cartridge may include a photoreceptor on which an electrostatic latent image is formed, and mounting and removal directions of the photoreceptor cartridge and the development cartridge may be a traverse direction crossing a length direction of the photoreceptor at right angles.

The electrophotographic image forming apparatus may include a cover opening and closing the opening, and including a pressurization portion for fixing the development cartridge to the mounting portion by pressurizing the development cartridge while the opening is closed.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Figure 1:
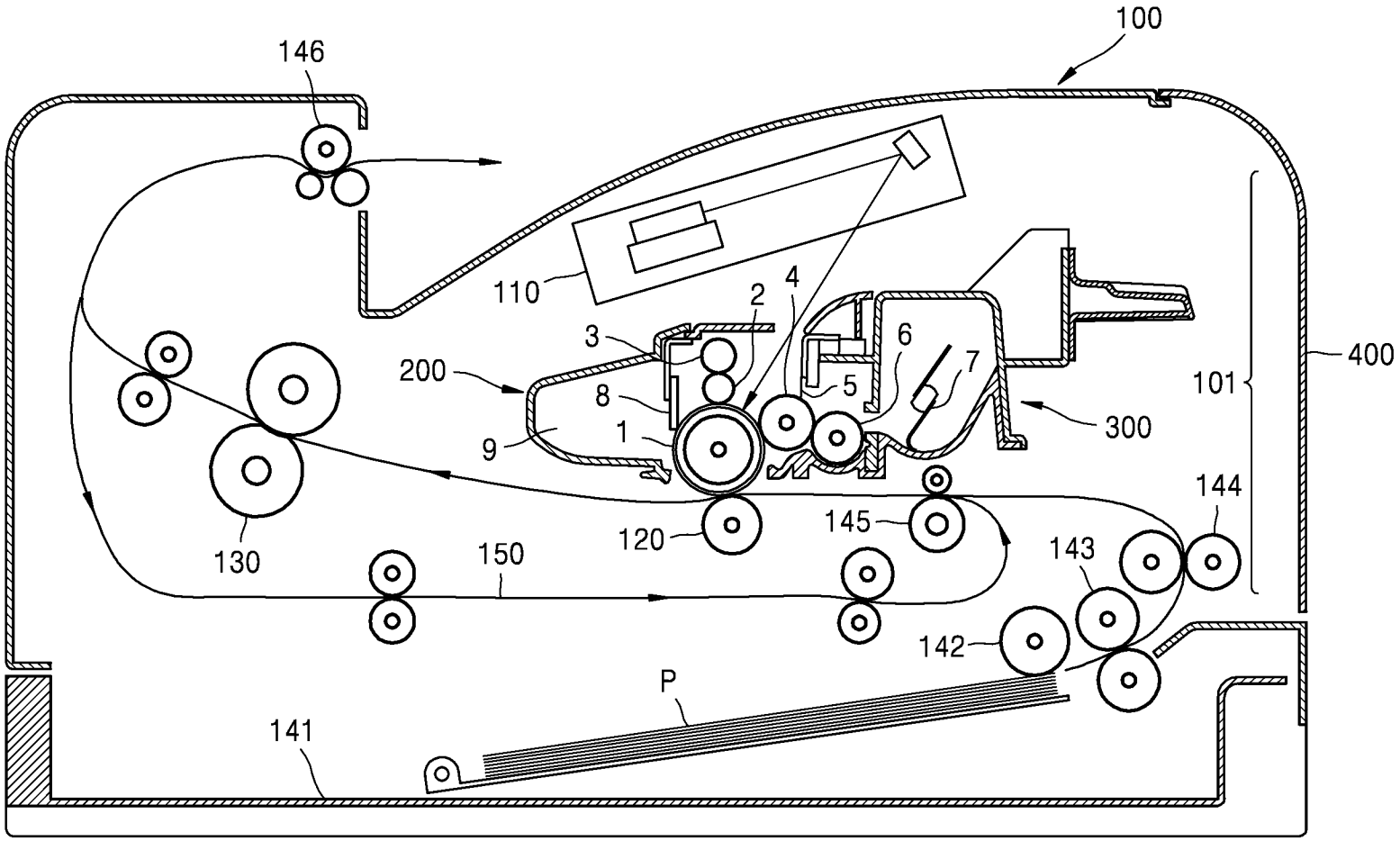
FIG. 1 illustrates an electrophotographic image forming apparatus according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

The present invention is described fully with reference to the accompanying drawings, in which exemplary embodiments of the present invention are shown. In the drawings, like reference numerals denote like elements.

Figure 2:
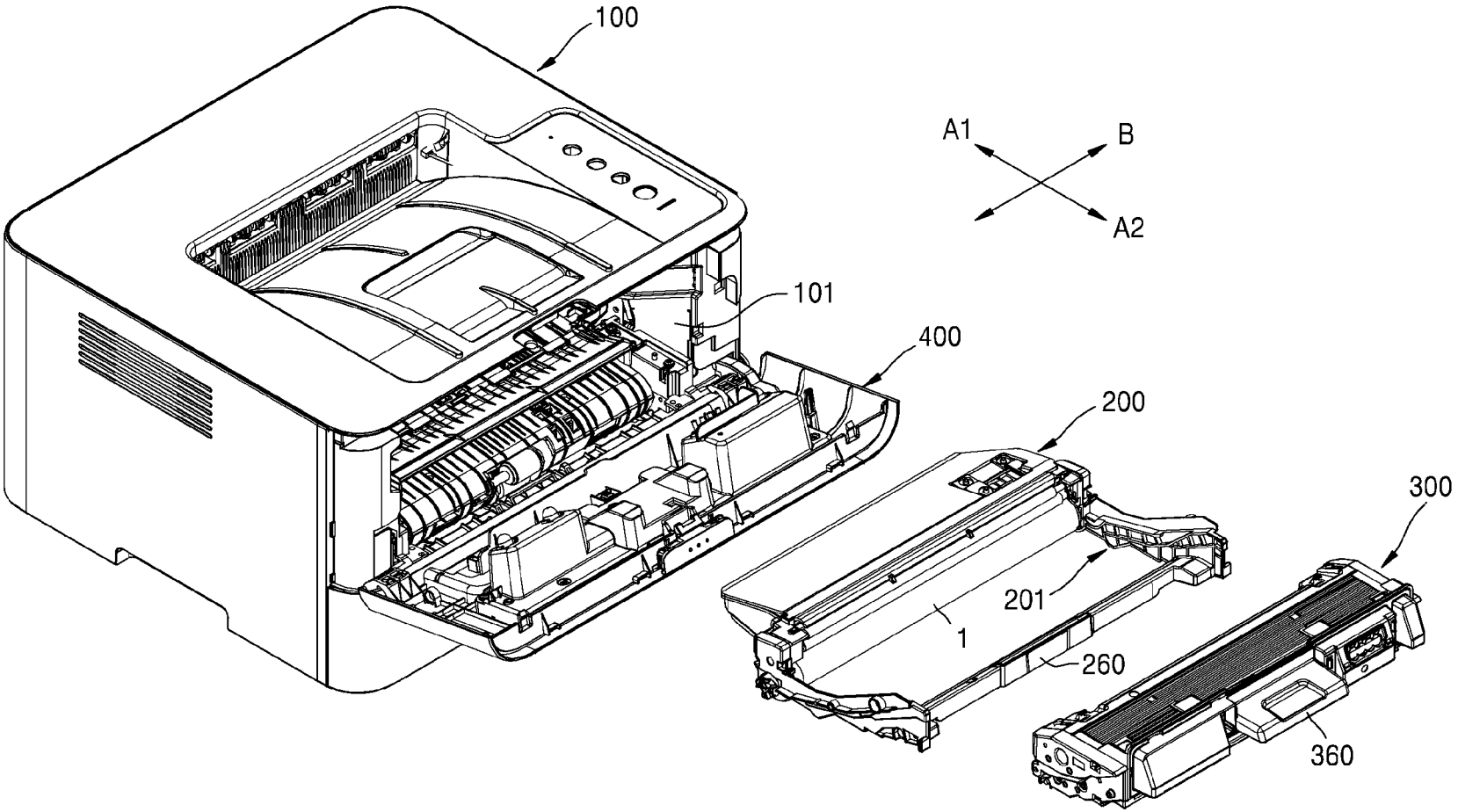
FIG. 2 illustrates of an electrophotographic image forming apparatus, according to an embodiment of the present invention.

FIG. 1 illustrates an electrophotographic image forming apparatus according to an embodiment of the present invention. FIG. 2 illustrates an electrophotographic image forming apparatus of FIG. 1, according to an embodiment of the present invention.

Referring to FIGS. 1 and 2, a body 100, a photoreceptor cartridge 200, and a development cartridge 300 are illustrated. The body 100 includes an opening 101 providing a passage for the photoreceptor cartridge 200 and the development cartridge 300 to be mounted or removed. A cover 400 closes, or opens, the opening 101. The body 100 includes an exposure unit 110, a transfer roller 120, and a fusing unit 130. The body 100 includes a recording medium transfer structure for loading and transferring a recording medium P where an image may be formed.

The photoreceptor cartridge 200 includes a photoconductive drum 1. The photoconductive drum 1 is an example of a photoreceptor, wherein an electrostatic latent image is formed on a surface thereof, and may include a conductive metal pipe and a photosensitive layer around the conductive metal pipe. A charging roller 2 is an example of a charger for charging the photoconductive drum 1 to have uniform surface potential. A charging brush or a corona charger may be used instead of the charging roller 2. A cleaning roller 3 may be used for removing foreign materials on a surface of the charging roller 2. A cleaning blade 8 is an example of a cleaning unit for removing toner and foreign materials on a surface of the photoconductive drum 1 after a transfer process. A cleaning apparatus having another shape, such as a rotating brush, may be used instead of the cleaning blade 8. The toner and foreign materials removed by the cleaning blade 8 may be contained in a waste toner container 9.

The development cartridge 300 supplies toner contained therein to an electrostatic latent image formed on the photoconductive drum 1 to develop the electrostatic latent image into a visible toner image. When a one-component development method is used, toner may be contained in the development cartridge 300, and when a two-component development method is used, toner and a carrier may be contained in the development cartridge 300. A development roller 4 is used to supply the toner in the development cartridge 300 to the photoconductive drum 1. A development bias voltage may be applied to the development roller 4. A regulator 5 constrains an amount of toner supplied from the development roller 4 to a development region where the photoconductive drum 1 and the development roller 4 face each other. The regulator 5 may be a doctor blade elastically contacting a surface of the development roller 4.

Figure 3A:
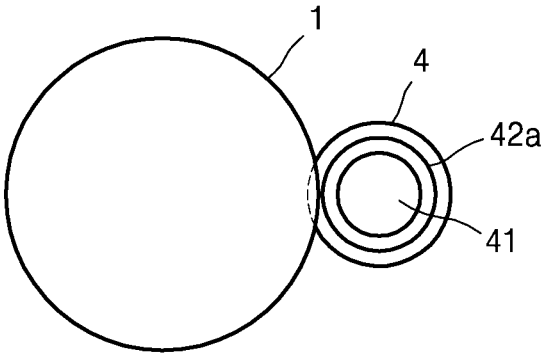
FIG. 3A illustrates an exemplary photoconductive drum and a development roller in a contact development method.
Figure 3B:
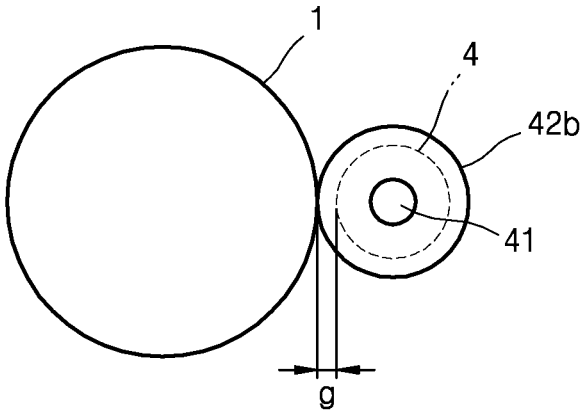
FIG. 3B illustrates an exemplary photoconductive drum and a development roller in a non-contact development method.

A one-component development method may be used according to an exemplary embodiment. The one-component development method may be classified as a contact development method, wherein the development roller 4 and the photoconductive drum 1 are rotated while contacting each other, or a non-contact development method, wherein the development roller 4 and the photoconductive drum 1 are rotated by being spaced apart from each other by dozens to hundreds of microns. FIG. 3A illustrates an exemplary arrangement of the photoconductive drum 1 and the development roller 4 in the contact development method. FIG. 3B illustrates an exemplary arrangement of the photoconductive drum 1 and the development roller 4 in the non-contact development method. Referring to FIG. 3A, in the contact development method, a gap maintaining member 42*a* having a smaller diameter than the development roller 4 may be provided on each of both ends of a rotation shaft 41 of the development roller 4. A contact amount of the development roller 4 to the photoconductive drum 1 may be constrained as the gap maintaining member 42*a* contacts the surface of the photoconductive drum 1. Referring to FIG. 3B, in the non-contact development method, a gap maintaining member 42*b* having a larger diameter than the development roller 4 may be provided on each of the both ends of the rotation shaft 41 of the development roller 4. A gap "g" between the development roller 4 and the photoconductive drum 1 may be constrained as the gap maintaining member 42*b* contacts the surface of the photoconductive drum 1. The development cartridge 300 may further include a supply roller 6 for adhering the toner to the surface of the development roller 4. A supply bias voltage may be applied to the supply roller 6. The development cartridge 300 may further include an agitator 7 for stirring the toner and supplying the toner towards the supply roller 6 and the development roller 4. The agitator 7 may stir and triboelectrically charge the toner.

When a two-component development method is used, the development roller 4 may be spaced apart from the photoconductive drum 1 by dozens to hundreds of microns. Although not illustrated, the development roller 4 may have a structure wherein a magnetic roller is disposed in a hollow cylindrical sleeve. The toner may be adhered to a surface of a magnetic carrier. The magnetic carrier may be adhered to the surface of the development roller 4 to be transferred to the development region where the photoconductive drum 1 and the development roller 4 face each other. According to an exemplary embodiment, only the toner is supplied to the photoconductive drum 1 according to the development bias voltage applied between the development roller 4 and the photoconductive drum 1, and thus the electrostatic latent image formed on the surface of the photoconductive drum 1 is developed into the visible toner image. The development cartridge 300 may include a transport agitator (not shown) for mixing and stirring the toner and a carrier and transporting the mixture to the development roller 4. The transport agitator may be an auger, and a plurality of the transport agitators may be provided in the development cartridge 300.

Examples of development methods of the electrophotographic image forming apparatus according to an embodiment have been described above, but the present invention is not limited thereto, and development methods may be variously modified and changed.

The exposure unit 110 forms the electrostatic latent image on the photoconductive drum 1 by irradiating light modulated according to image information to the photoconductive drum 1. The exposure unit 110 may be a laser scanning unit (LSU) using a laser diode as a light source, or a light-emitting diode (LED) exposure unit using an LED as a light source.

The transfer roller 120 is an example of a transfer unit for transferring a toner image from the photoconductive drum 1 to the recording medium P. A transfer bias voltage for transferring the toner image to the recording medium P is applied to the transfer roller 120. A corona transfer unit or a transfer unit using a pin scorotron method may be used instead of the transfer roller 120.

The recording media P may be picked up one by one from a loading table 141 by a pickup roller 142, and are transferred to a region where the photoconductive drum 1 and the transfer roller 120 face each other by feed rollers 143, 144, and 145.

The fusing unit 130 applies heat and pressure to an image transferred to the recording medium P so as to fuse the image on the recording medium P. The recording medium P that passed through the fusing unit 130 is discharged outside the body 100 by a discharge roller 146.

According to an exemplary embodiment, the exposure unit 110 irradiates the light modulated according to the image information to the photoconductive drum 1 to develop the electrostatic latent image. The development roller 4 supplies the toner to the electrostatic latent image to form the visible toner image on the surface of the photoconductive drum 1. The recording medium P loaded in the loading table 141 is transferred to the region where the photoconductive drum 1 and the transfer roller 120 face each other by the pickup roller 142 and the feed rollers 143, 144, and 145, and the toner image is transferred on the recording medium P from the photoconductive drum 1 according to the transfer bias voltage applied to the transfer roller 120. After the recording medium P passes through the fusing unit 130, the toner image is fused on the recording medium P according to heat and pressure. After the fusing, the recording medium P is discharged by the discharge roller 146. When duplex printing is performed, after an imaged is printed on a front side of the recording medium P, the recording medium P is re-transferred to the region where the photoconductive drum 1 and the transfer roller 120 face each other along a reverse transfer path 150 as the discharge roller 146 is reverse-rotated. A new toner image is transferred to, and fused on, a rear side of the recording medium P. The recording medium P having duplex images is discharged by the discharge roller 146.

The photoreceptor cartridge 200 and the development cartridge 300 are consumable products that are replaced after their lives are expired. Since lives of the photoreceptor cartridge 200 and the development cartridge 300 may be different, the photoreceptor cartridge 200 and the development cartridge 300 may be individually replaced.

A process cartridge, wherein the photoreceptor cartridge 200 and the development cartridge 300 are combined to each other, may be mounted in, or removed from, the body 100. For example, when only the development cartridge 300 is to be replaced, the process cartridge is removed from the body 100, the combination of the photoreceptor cartridge 200 and the development cartridge 300 is released, a new development cartridge 300 is combined to the photoreceptor cartridge 200, and the process cartridge is mounted in the body 100. Accordingly, processes for replacing the development cartridge 300 are complex. Since a weight of the process cartridge is heavy, it may be difficult to handle the process cartridge during mounting and removing processes.

According to an exemplary embodiment, the photoreceptor cartridge 200 is mounted in the body 100. The development cartridge 300 is mounted in a mounting portion 201 provided in the photoreceptor cartridge 200. When removing the photoreceptor cartridge 200 and the development cartridge 300, the photoreceptor cartridge 200 is removed from the body 100 after the development cartridge 300 is removed from the mounting portion 201. Accordingly, since the photoreceptor cartridge 200 and the development cartridge 300 may be individually mounted in, or removed from, the body 100, it is easy to replace the photoreceptor cartridge 200 or the development cartridge 300. Since the photoreceptor cartridge 200 and the development cartridge 300 are individually handled during the mounting and removing processes, user convenience may be improved as a burden of weights may be reduced.

Hereinafter, "front" is defined as a mounting direction A1 of the photoreceptor cartridge 200 and the development cartridge 300, and "rear" is defined as an opposite direction of the mounting direction A1, i.e., a removal direction A2.

Figure 4:
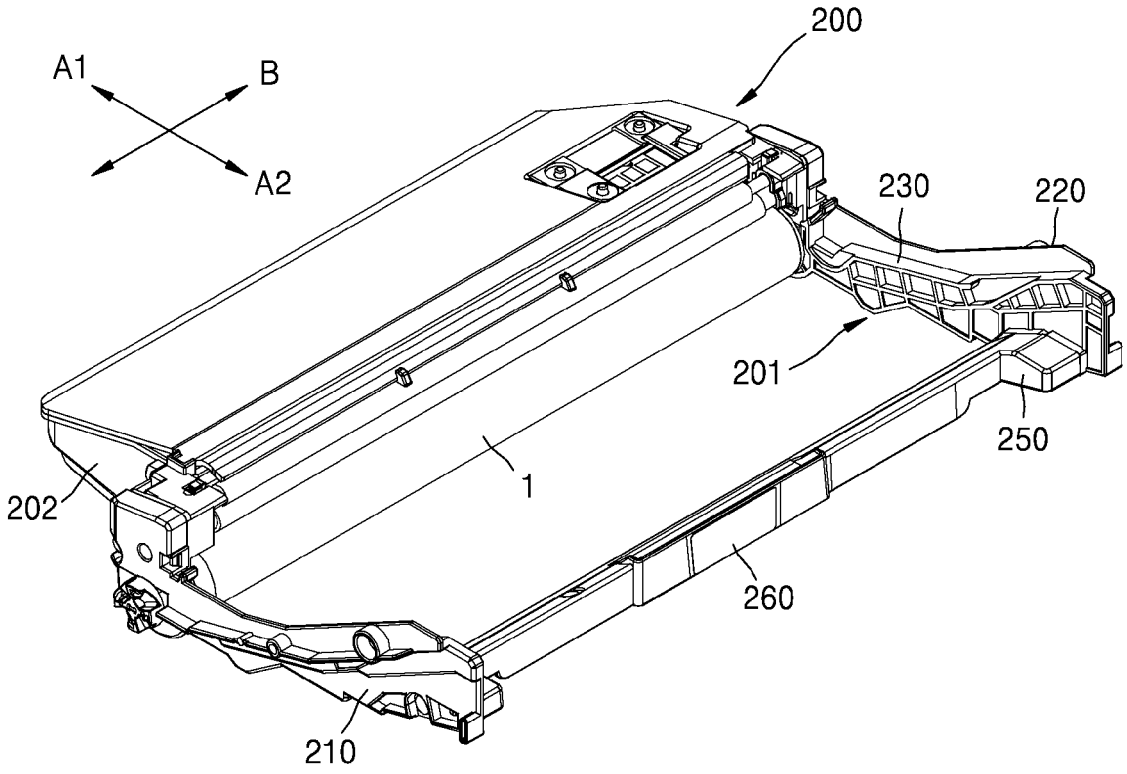
FIG. 4 illustrates a photoreceptor cartridge according to an embodiment of the present invention.
Figure 5:
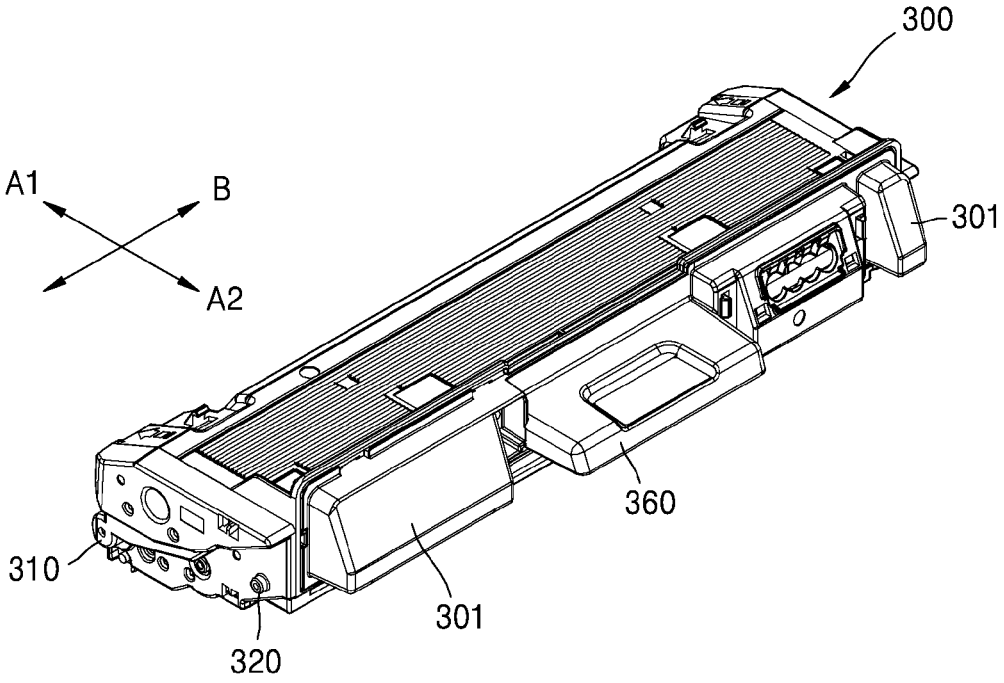
FIG. 5 illustrates a development cartridge according to an embodiment of the present invention.

FIG. 4 illustrates photoreceptor cartridge 200 according to an embodiment of the present invention. FIG. 5 illustrates a development cartridge 300 according to an embodiment of the present invention. Referring to FIGS. 4 and 5, the photoreceptor cartridge 200 includes the mounting portion 201 where the development cartridge 300 is mounted. The mounting portion 201 may include, for example, first and second guide members 210 and 220 extending backwards respectively from both side portions of a frame 202 of the photoreceptor cartridge 200. The first and second guide members 210 and 220 may be connected to each other by a connecting member 250 extending in a length direction B of the photoconductive drum 1. The connecting member 250 may be connected to rear ends of the first and second guide members 210 and 220. Guide rails 230 are provided at inner walls of the first and second guide members 210 and 220. First and second guide protrusions 310 and 320 are provided respectively on both side portions of the development cartridge 300. The second guide protrusion 320 may be disposed at a location spaced apart from the first guide protrusion 310 in backwards. The development cartridge 300 is mounted in, or removed from, the mounting portion 201 as the first and second guide protrusions 310 and 320 are supported by the guide rail 230.

Figure 6:
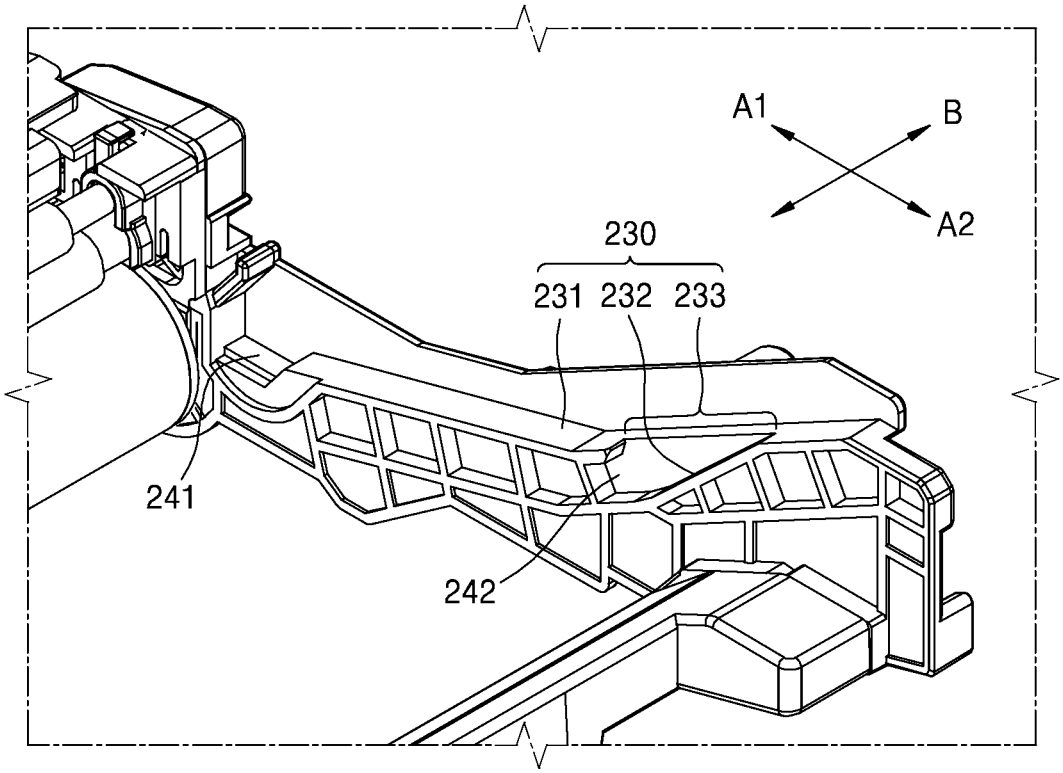
FIG. 6 illustrates a guide rail, according to an embodiment of the present invention.

FIG. 6 illustrates a guide rail 230, according to an embodiment of the present invention. Referring to FIG. 6, the guide rail 230 guides the first and second guide protrusions 310 and 320 respectively to first and second accommodation portions 241 and 242. The guide rail 230 may have a rib shape protruding inward from the inner walls of the first and second guide members 210 and 220. The first and second guide protrusions 310 and 320 may have a boss shape externally protruding respectively from the both side portions of the development cartridge 300. The guide rail 230 may include a first guide rail 231 for guiding the first guide protrusion 310 to the first accommodation portion 241, and a second guide rail 232 for guiding the second guide protrusion 320 to the second accommodation portion 242. The second guide rail 232 may be branched from the first guide rail 231 and extends towards the second accommodation portion 242. A protrusion amount of the second guide protrusion 320 from a side wall of the development cartridge 300 may be smaller than a protrusion amount of the first guide protrusion 310. The protrusion amount of the first guide rail 231 from the inner wall of the first and second guide members 210 and 220 near a branching location 233 where the second guide rail 232 is branched from the first guide rail 231 may be smaller than that of the second guide rail 232. Accordingly, the first guide protrusion 310 may be continuously guided by the first guide rail 231 by passing through the branching location 233, whereas the second guide protrusion 320 deviates from the first guide rail 231 and is guided by the second guide rail 232 while passing through the branching location 233. The first accommodation portion 241 may have a shape, for example, a U- or V-shape, such that the first guide protrusion 310 having a cylindrical shape may be inserted and accommodated therein. The second accommodation portion 242 may have a shape, for example, a lying U- or V-shape, such that the second guide protrusion 320 having a cylindrical shape is inserted and accommodated therein and does not leave from the second accommodation portion 242 upwardly. However, the shapes of the first and second accommodation portions 241 and 242 are not limited thereto.

Figure 7A:
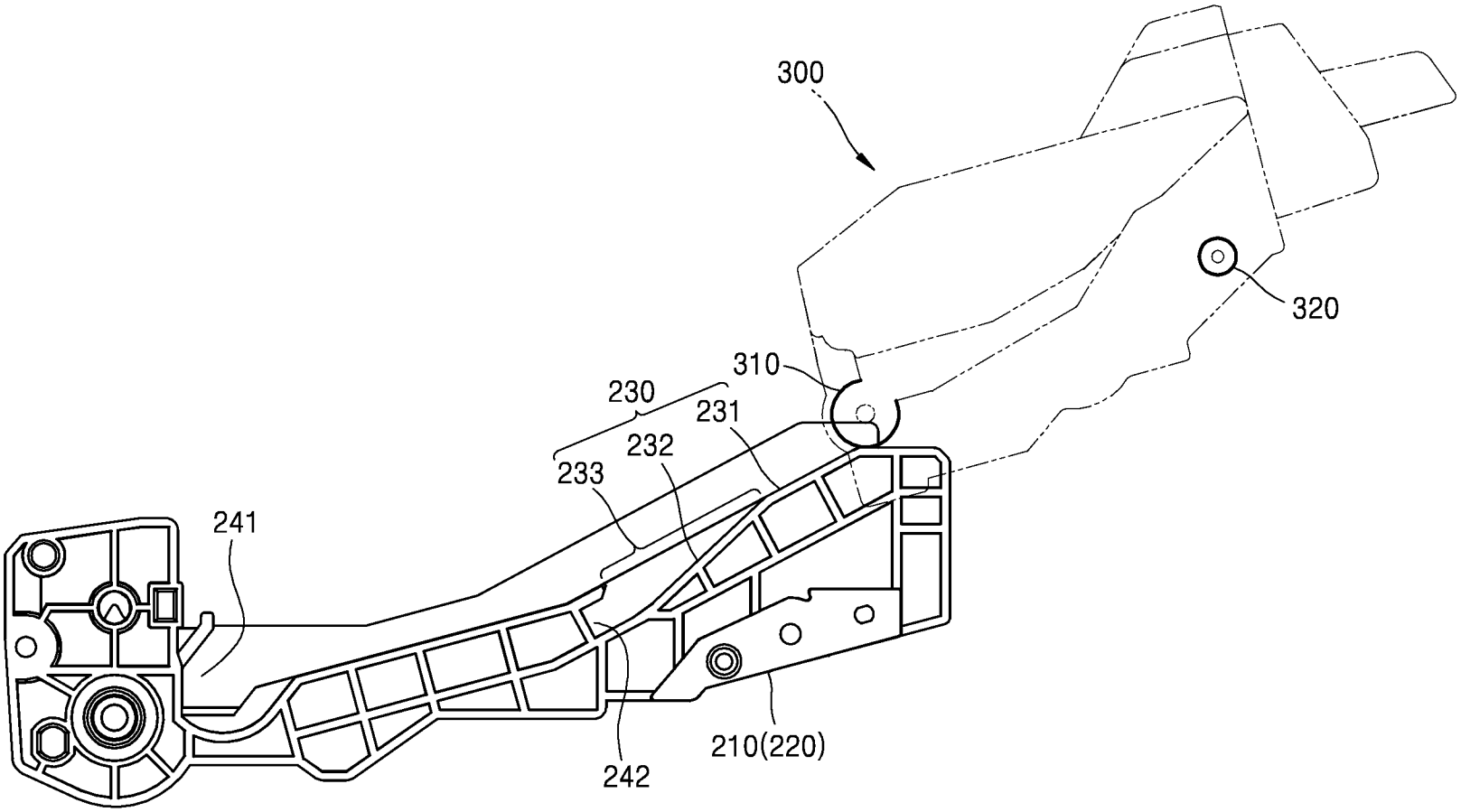
FIGS. 7A through 7C illustrate an exemplary process of mounting a development cartridge in a mounting portion after a photoreceptor cartridge is mounted in a body, according to an embodiment of the present invention.
Figure 7B:
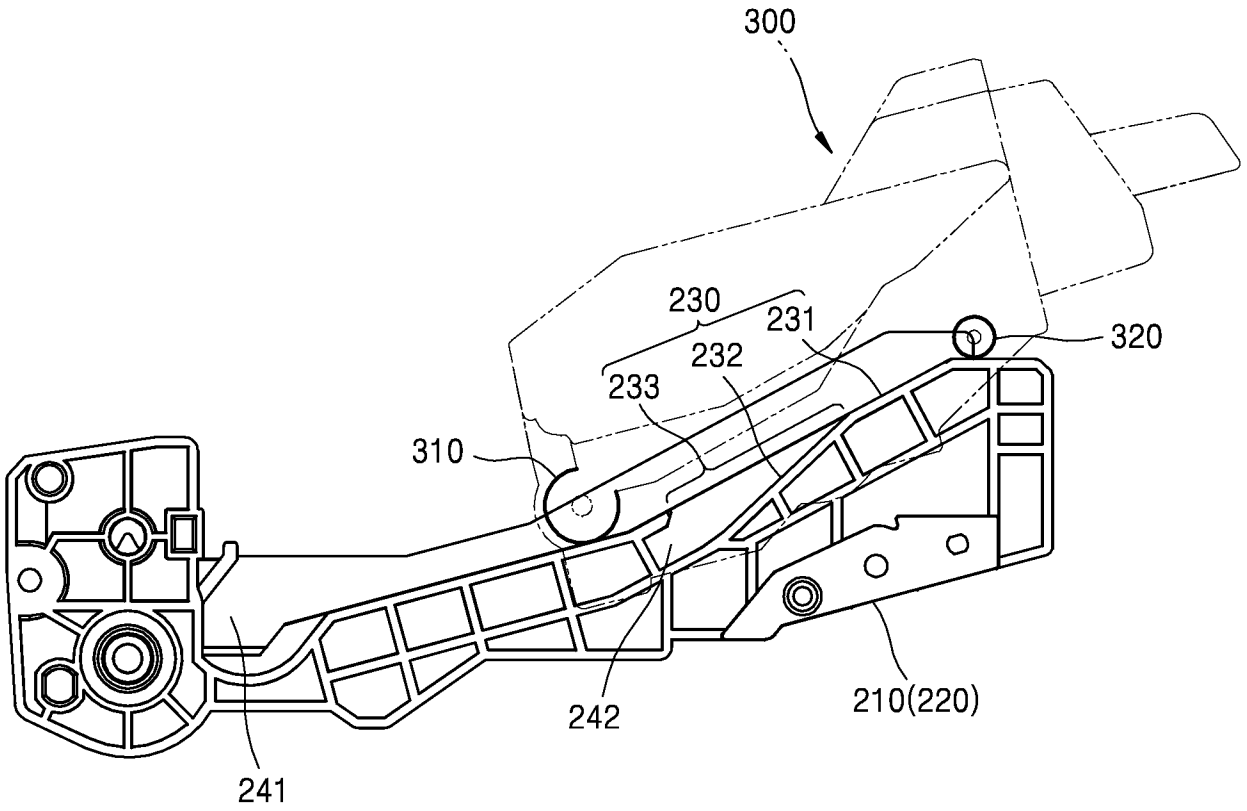
Figure 7C:
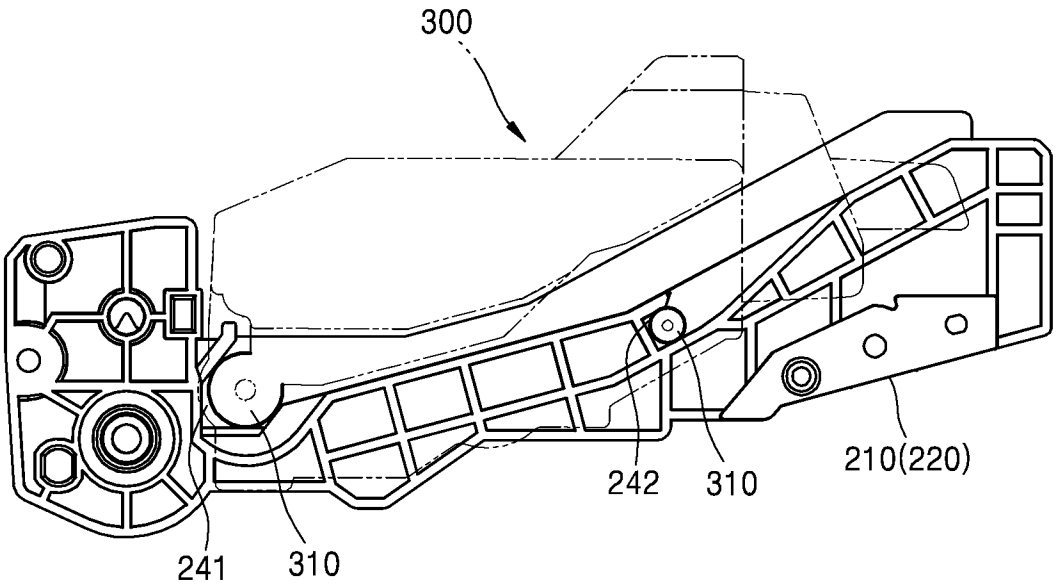

FIGS. 7A through 7C illustrate an exemplary process of mounting the development cartridge 300 in the mounting portion 201 after the photoreceptor cartridge 200 is mounted in the body 100, according to an embodiment of the present invention. While the photoreceptor cartridge 200 is mounted in the body 100, the development cartridge 300 may be drawn near the body 100 as illustrated in FIG. 7A so that the first guide protrusion 310 is supported by the first guide rail 231. The development cartridge 300 may be pushed into the body 100. The first guide protrusion 310 approaches the first accommodation portion 241 by being guided by the first guide rail 231 over the branching location 233. As the development cartridge 300 is inserted into the body 100, the second guide protrusion 320 begins to be guided by the first guide rail 231. Since the protrusion amount of the second guide protrusion 320 is smaller than the first guide protrusion 310, when the second guide protrusion 320 reaches the branching location 233, the second guide protrusion 320 is separated from the first guide rail 231 and is guided by the second guide rail 232 as illustrated in FIG. 7B. When the development cartridge 300 is continuously inserted into the body 100, the first and second guide protrusions 310 and 320 are respectively guided by the first and second guide rails 231 and 232 and accommodated in the first and second accommodation portions 241 and 242 as illustrated in FIG. 7C.

When attaching/detaching directions of the development cartridge 300 and the photoreceptor cartridge 200 are perpendicular to a transfer direction of the recording medium P, i.e., are a length direction of the photoconductive drum 1, the photoconductive drum 1 and the development roller 4 may interfere with other components in the body 100 or the development cartridge 300 and the photoconductive drum 1 may interfere with each other, and thus a risk of the photoconductive drum 1 and the development roller 4 being damaged may be high, while the development cartridge 300 and the photoreceptor cartridge 200 are attached to, or detached from, the body 100. According to the electrophotographic image forming apparatus of the current embodiment, the mounting direction A1 and the removal direction A2 of the photoreceptor cartridge 200 and the development cartridge 300 are the transfer direction of the recording medium P. In other words, the mounting direction A1 and the removal direction A2 are a transverse direction crossing the length direction B of the photoconductive drum 1 at right angles. According to such a structure, the development roller 4 and the photoconductive drum 1 barely interfere with each other while mounting the development cartridge 300 in the mounting portion 201. Accordingly, a risk of damage caused by interference between the development roller 4 and the photoconductive drum 1 may be reduced.

Even when the development cartridge 300 is mounted in the mounting portion 201 of the photoreceptor cartridge 200 after the photoreceptor cartridge 200 is mounted in the body 100, the development cartridge 300 is not fixedly combined to the photoreceptor cartridge 200. That is a user may remove the development cartridge 300 from the photoreceptor cartridge 200 and the body 100 by pulling the development cartridge 300 in a removal direction, without having to unlock the development cartridge 300 from the photoreceptor cartridge 200. According to the electrophotographic image forming apparatus of an exemplary embodiment, the development cartridge 300 may be pressurized in the mounting direction by closing the cover 400, thereby fixing the development cartridge 300 to the photoreceptor cartridge 200.

Figure 8:
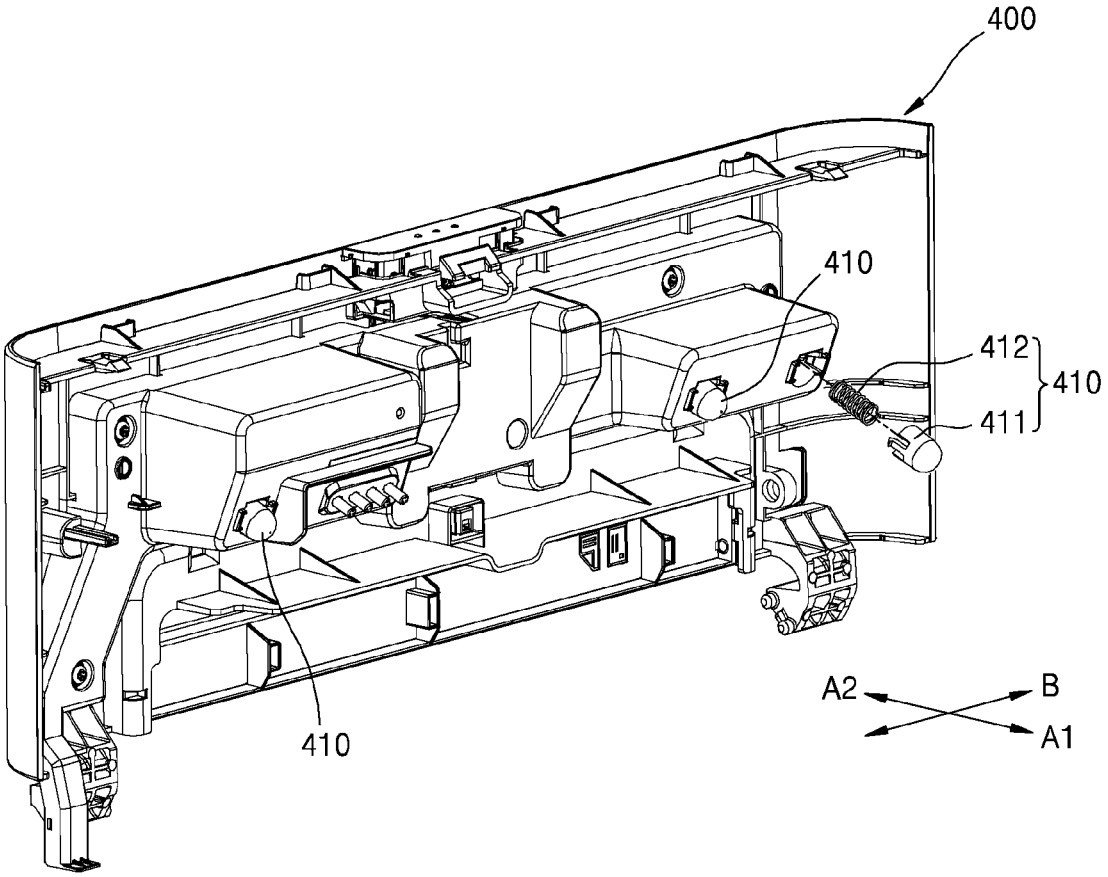
FIG. 8 illustrates a cover according to an embodiment of the present invention.
Figure 9:
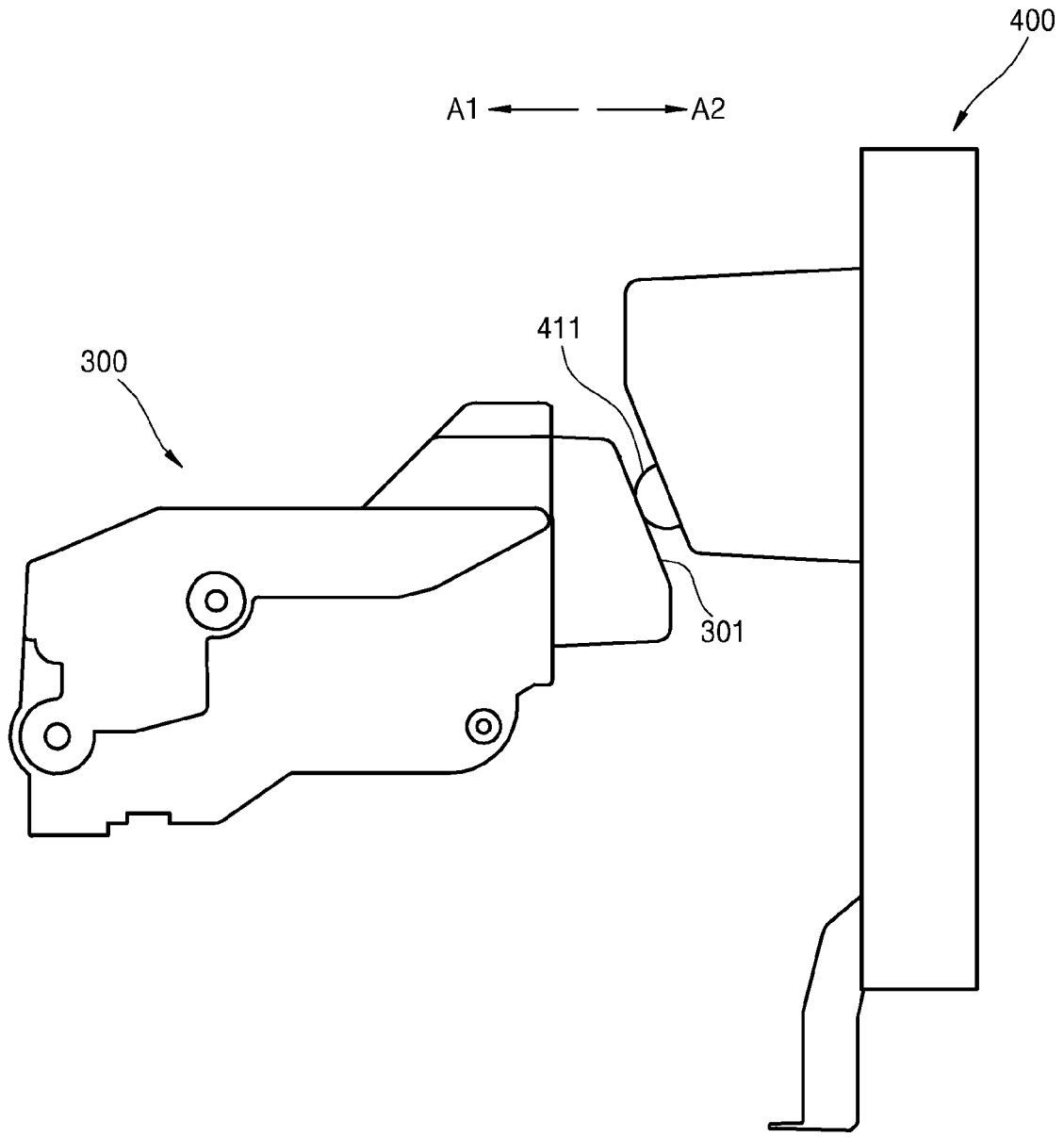
FIG. 9 illustrates an exemplary state of a development cartridge being pressurized by a pressurization portion while a cover is closed, according to an embodiment of the present invention.

FIG. 8 illustrates a cover 400 according to an embodiment of the present invention. FIG. 9 is a side view illustrating a state of the development cartridge 300 being pressurized by a pressurization portion 410 while the cover 400 is closed, according to an embodiment of the present invention. Referring to FIG. 8, the cover 400 includes the pressurization portion 410. The pressurization portion 410 may include, for example, a pressurization member 411 for pressurizing the development cartridge 300, and an elastic member 412 for providing elastic force to the pressurization member 411 to push the development cartridge 300 in the mounting direction A1. The elastic member 412 may be a compressed coil spring. The pressurization member 411 may push a rear surface of the development cartridge 300. For example, referring to FIGS. 4 and 9, a pressure-receiving portion 301 to which the pressurization member 411 contacts may be provided at a rear portion of the development cartridge 300. When the cover 400 is closed, as illustrated in FIG. 9, after mounting the development cartridge 300 in the mounting portion 201 of the photoreceptor cartridge 200 mounted in the body 100, elastic force may be applied to the development cartridge 300 in the mounting direction A1 by the pressurization portion 410. The development cartridge 300 is pushed in the mounting direction A1 by the elastic force, and is stopped while the gap maintaining member 42*a* or 42*b* contacts the photoconductive drum 1, as illustrated in FIG. 3A or 3B. Since the first and second guide protrusions 310 and 320 may be respectively accommodated in the first and second accommodation portions 241 and 242 having the U- or V-shape, the first and second guide protrusions 310 and 320 do not deviate from the first and second accommodation portions 241 and 242 in a direction crossing the mounting direction A1 (a direction of the elastic force). Accordingly, the development cartridge 300 may be fixed to the photoreceptor cartridge 200.

As such, by fixing the development cartridge 300 to the mounting portion 201 by closing the cover 400, a locking apparatus or the like for fixing the development cartridge 300 to the photoreceptor cartridge 200 does not need to be separately provided at the development cartridge 300 or the photoreceptor cartridge 200, and thus material costs may be reduced. Since the combination of the development cartridge 300 and the photoreceptor cartridge 200 may be maintained/released only by opening and closing the cover 400, processes of mounting/detaching the development cartridge 300 and the photoreceptor cartridge 200 may be simplified, and thus user convenience may be improved.

Referring to FIG. 4, a first handle 260 for the user to hold while mounting or removing the photoreceptor cartridge 200 in, or from, the body 100 may be provided in the photoreceptor cartridge 200. The first handle 260 may be located at the opening 101, i.e., at the rear of the photoreceptor cartridge 200, so as to be easily located by the user when the cover 400 is opened. For example, the first handle 260 may be provided at a center of the connecting member 250 connecting the first and second guide members 210 and 220.

Referring to FIG. 5, a second handle 360 for the user to hold while mounting or removing the development cartridge 300 in, or from, the body 100 may be provided in the development cartridge 300. The second handle 360 may be located at the opening 101, i.e., at the rear of the development cartridge 300 so as to be easily found by the user when the cover 400 is opened.

Figure 10:
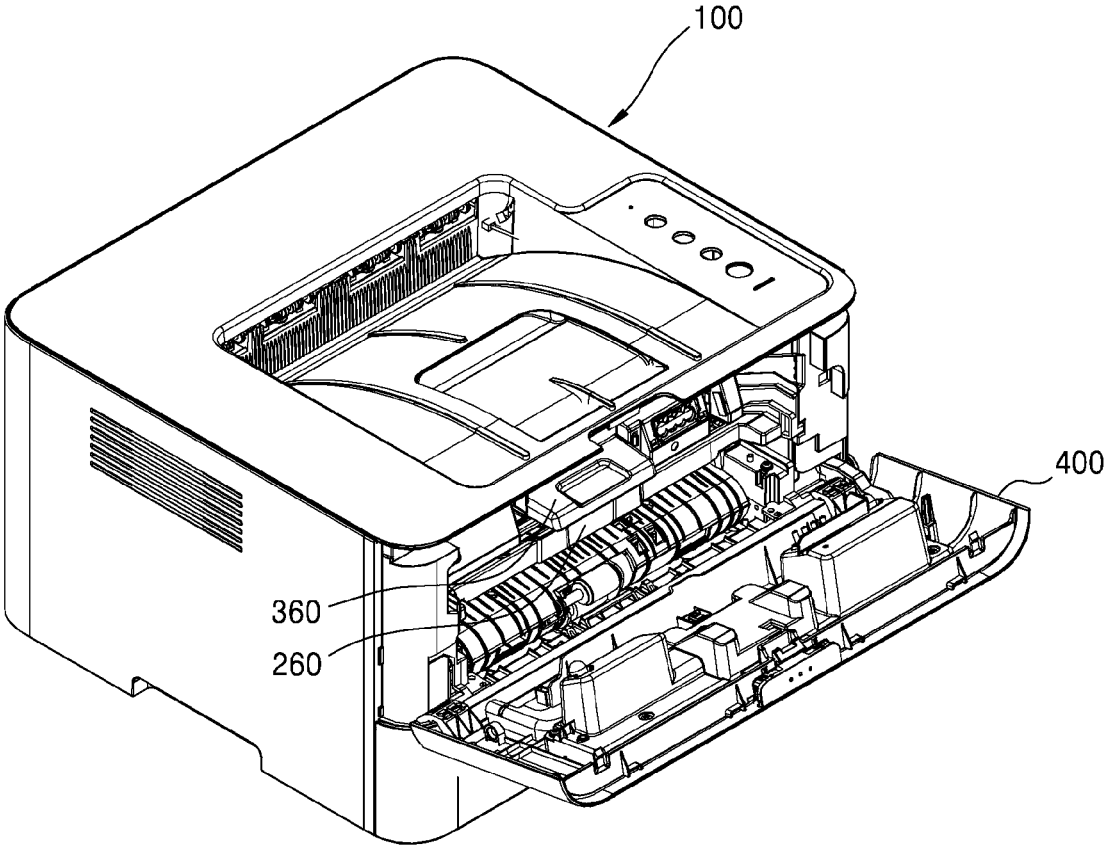
FIG. 10 illustrates an image forming apparatus according to an embodiment of the present invention, wherein a cover is opened.
Figure 11:
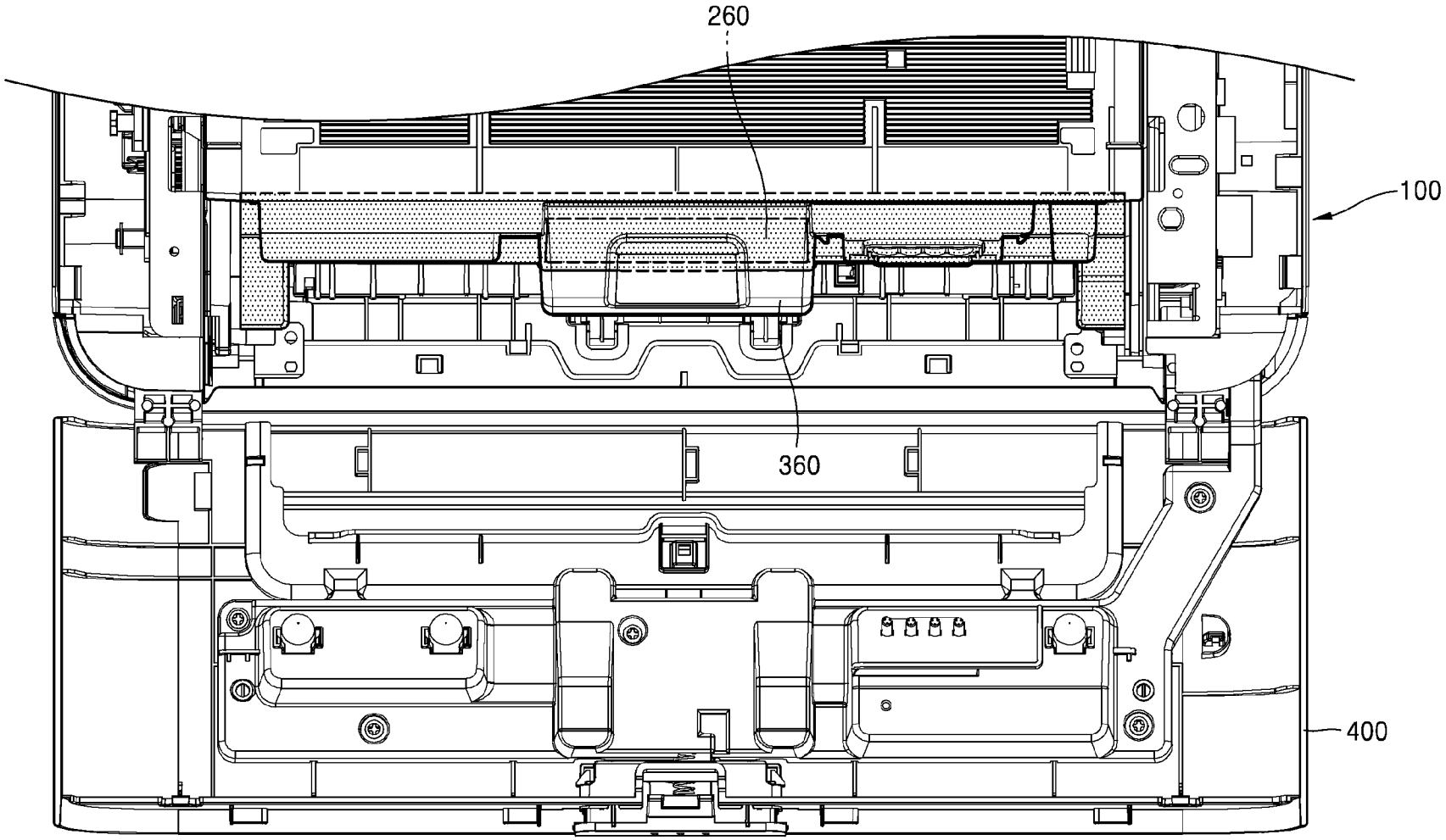
FIG. 11 illustrates an exemplary image forming apparatus.

According to the electrophotographic image forming apparatus of the current embodiment, when the photoreceptor cartridge 200 and the development cartridge 300 are removed from the body 100, the development cartridge 300 may be first removed from the mounting portion 201 of the photoreceptor cartridge 200, and then the photoreceptor cartridge 200 may be removed from the body 100. FIG. 10 is a perspective view of an image forming apparatus according to an embodiment of the present invention, wherein the cover 400 is opened. FIG. 11 is a plan view of the image forming apparatus of FIG. 10.

Referring to FIGS. 10 and 11, the second handle 360 may be located above the first handle 260 while the photoreceptor cartridge 200 and the development cartridge 300 are mounted in the body 100. Generally, an eye level of the user is higher than the electrophotographic image forming apparatus. A line of sight of the user looking into the body 100 through the opening 101 while the cover 400 of the body 100 is opened may be from top to bottom. Thus, the second handle 360 above the first handle 260 may be more easily found by the user, and the user may first hold the second handle 360 and remove the development cartridge 300. Since the first handle 260 may be located below the second handle 360, the first handle 260 is displayed by the dashed line in FIG. 11.

Alternatively, the second handle 360 may protrude further towards the opening 101 than the first handle 260. Accordingly, the first handle 260 may be disposed below the second handle 360 and is further inside the body 100 than the second handle 360. Considering an exemplary line of sight of the user looking from top to bottom, the user may easily locate the second handle 360. The first handle 260 may be hidden by the second handle 360 and thus may not be easily found by the user when the development cartridge 300 is not removed. Accordingly, the user may intuitively remove the development cartridge 300 first.

Figure 12:
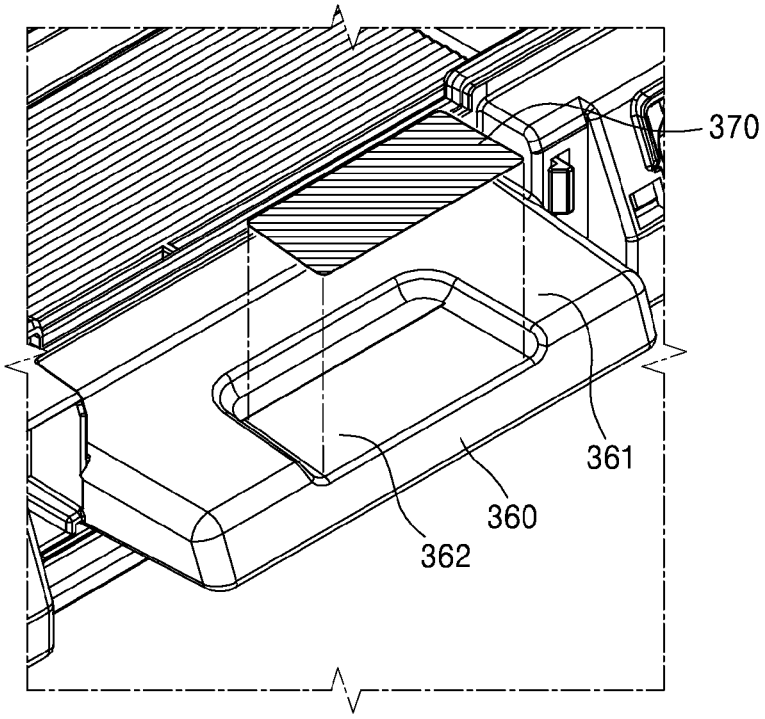
FIG. 12 illustrates a second handle, according to an embodiment of the present invention.

FIG. 12 is a perspective view of the second handle 360, according to an embodiment of the present invention. Referring to FIG. 12, a top surface 361 of the second handle 360 may include a recessed portion 362 that is partially recessed downward. The user may intuitively determine that the second handle 360 is a region to hold to mount, or remove, the development cartridge 300 based on a shape of the recessed portion 362. A display member 370 in a color (not shown) different from the development cartridge 300 may be disposed on the recessed portion 362 so that the user may be visually led to hold the second handle 360. The display member 370 may be a label attached to the recessed portion 362.

Figure 13:
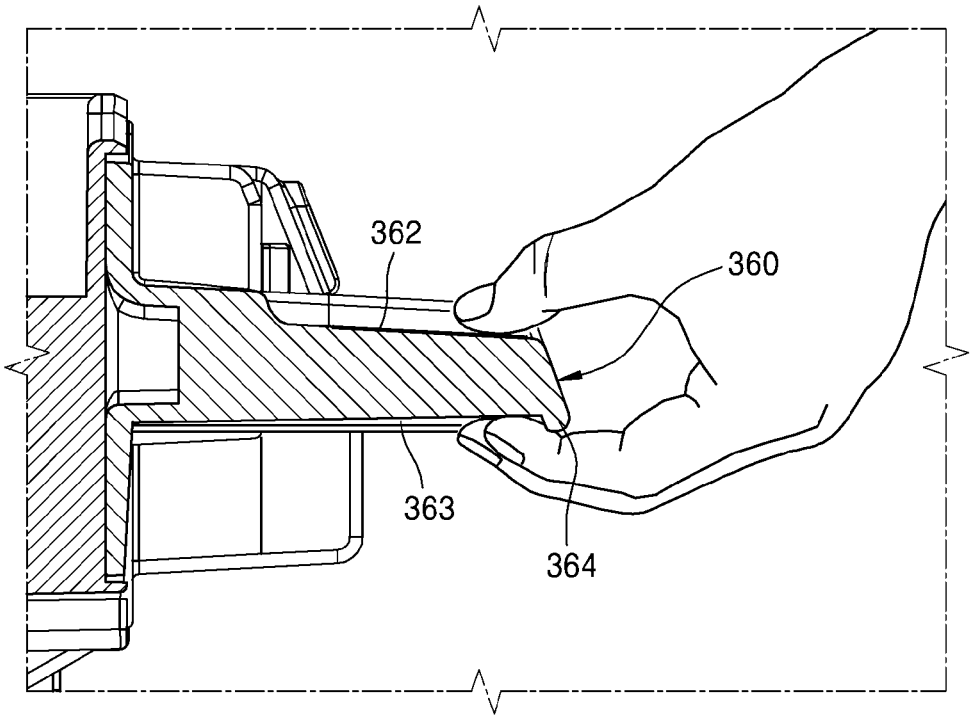
FIG. 13 illustrates a second handle according to an embodiment of the present invention.
Figure 14:
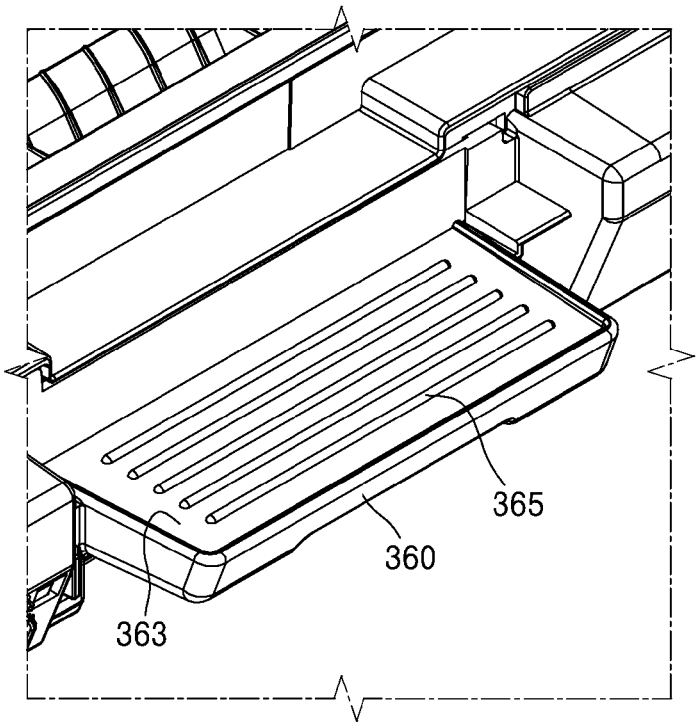
FIGS. 14 and 15 illustrates a bottom surface of a second handle, according to an exemplary embodiment of the present invention.
Figure 15:
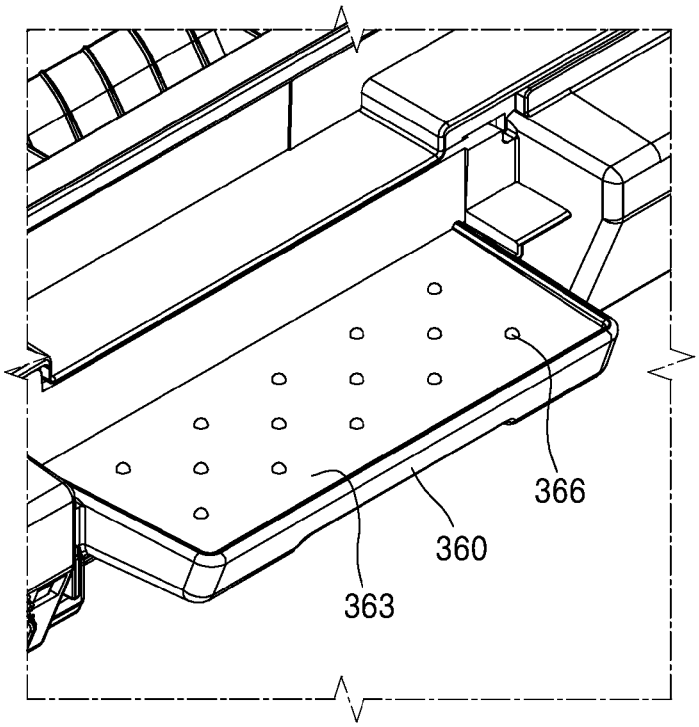

Partially recessed may be defined as an area of the recessed portion 362 smaller than an area of the top surface 361. Accordingly, the user may intuitively hold the second handle 360 by putting a thumb, for example, on the recessed portion 362 and other fingers on a bottom surface 363 of the second handle 360 as illustrated in FIG. 13. FIG. 13 is a cross-sectional view of the second handle 360 according to an embodiment of the present invention. Referring to FIG. 13, a rear edge portion 364 of the second handle 360 protrudes from the bottom surface 363. As illustrated in FIG. 13, since the other fingers are restrained by the rear edge portion 364, the user may easily pull and remove the development cartridge 300. FIGS. 14 and 15 are perspective views of the bottom surface 363 of the second handle 360, according to exemplary embodiments of the present invention. Referring to FIGS. 14 and 15, an uneven pattern may be formed on the bottom surface 363 of the second handle 360 for the user to easily hold the second handle 360. The uneven pattern may be linear protrusions 365 as illustrated in FIG. 14, or dot type protrusions 366 as illustrated in FIG. 15. However, the uneven pattern is not limited thereto and may vary.

While the present invention has been particularly shown and described with reference to exemplary embodiments thereof, it will be understood by those of ordinary skill in the art that various changes in form and details may be made therein without departing from the spirit and scope of the present invention as defined by the following claims.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An electrophotographic image forming apparatus comprising:

a body comprising an opening;

a photoreceptor cartridge attached to, or detached from, the body through the opening, and comprising a mounting portion;

a development cartridge attached to, or detached from, the mounting portion through the opening in a state where the photoreceptor cartridge is mounted in the body; and a cover opening, or closing, the opening, and comprising a pressurization portion for fixing the development cartridge to the mounting portion by pressurizing the development cartridge while the opening is closed, wherein the mounting portion comprises first and second guide members respectively extending from both side portions of the photoreceptor cartridge towards the opening to support both side portions of the development cartridge, wherein the mounting portion comprises guide rails provided at each of the first and second guide members, and first and second accommodation portions, and wherein first and second guide protrusions guided by the guide rails and respectively accommodated in the first and second accommodation portions are provided respectively at the both side portions of the development cartridge.

2. The electrophotographic image forming apparatus of claim 1, wherein the photoreceptor cartridge comprises a photoreceptor on which an electrostatic latent image is formed, and mounting and removal directions of the photoreceptor cartridge and the development cartridge are a traverse direction crossing a length direction of the photoreceptor at right angles.

3. The electrophotographic image forming apparatus of claim 1, wherein the guide rails comprise a first guide rail for guiding the first guide protrusion to the first accommodation portion, and a second guide rail for guiding the second guide protrusion to the second accommodation portion by being branched from the first guide rail.

4. The electrophotographic image forming apparatus of claim 1, wherein a protrusion amount of the second guide protrusion from both side walls of the development cartridge is smaller than a protrusion amount of the first guide protrusion, the first and second guide rails each have a rib shape respectively protruding from inner walls of the first and second guide members, and a protrusion amount of the first guide rail from the inner wall is smaller than a protrusion amount of the second guide rail near a branching location of the second guide rail.

5. An electrophotographic image forming apparatus comprising:

a body comprising an opening;

a photoreceptor cartridge attached to, or detached from, the body through the opening, and comprising a mounting portion;

a development cartridge attached to, or detached from, the mounting portion through the opening in a state where the photoreceptor cartridge is mounted in the body;

a cover opening, or closing, the opening, and comprising a pressurization portion for fixing the development cartridge to the mounting portion by pressurizing the development cartridge while the opening is closed;

a first handle provided at the photoreceptor cartridge; and a second handle provided at the development cartridge, wherein the second handle further protrudes towards the opening than the first handle.

6. The electrophotographic image forming apparatus of claim 5, wherein the second handle comprises a top surface and a bottom surface, wherein the top surface comprises a recessed portion partially recessed downward.

7. The electrophotographic image forming apparatus of claim 6, wherein a display member having a color different from a portion of the development cartridge is provided at the recessed portion.

8. The electrophotographic image forming apparatus of claim 6, wherein a rear edge of the second handle protrudes from the bottom surface.

9. The electrophotographic image forming apparatus of claim 6, wherein an uneven pattern is formed on the bottom surface.

10. The electrophotographic image forming apparatus of claim 5, further comprising:

a first handle provided at the photoreceptor cartridge, and a second handle provided at the development cartridge, wherein the second handle is located above the first handle.

11. An electrophotographic image forming apparatus comprising:

a body comprising an opening extending along a vertical plane substantially parallel to an external side of the body;

a photoreceptor cartridge attached to, or detached from, the body through the opening, and comprising a first handle and a mounting portion; and a development cartridge comprising a second handle and attached to, or detached from, the mounting portion through the opening in a state where the photoreceptor cartridge is mounted in the body, wherein the second handle protrudes further towards the opening than the first handle.

12. The electrophotographic image forming apparatus of claim 11, wherein the second handle is located above the first handle.

13. The electrophotographic image forming apparatus of claim 12, wherein the photoreceptor cartridge comprises a photoreceptor on which an electrostatic latent image is formed, and mounting and removal directions of the photoreceptor cartridge and the development cartridge are a traverse direction crossing a length direction of the photoreceptor at right angles.

14. The electrophotographic image forming apparatus of claim 11, further comprising a cover opening, and closing, the opening, and comprising a pressurization portion for fixing the development cartridge to the mounting portion by pressurizing the development cartridge while the opening is closed.

15. A cartridge for an electrophotographic image forming apparatus having a body with an opening, the cartridge comprising:

a photoreceptor cartridge attached to, or detached from, the body through the opening, and comprising a mounting portion; and a development cartridge attached to, or detached from, the mounting portion through the opening in a state where the photoreceptor cartridge is mounted in the body, and fixed to the the mounting portion by being pressurized when a cover over the opening is closed, wherein the mounting portion comprises first and second guide members respectively extending from both side portions of the photoreceptor cartridge towards the opening to support both side portions of the development cartridge, wherein the mounting portion comprises guide rails provided at each of the first and second guide members, and first and second accommodation portions, and wherein first and second guide protrusions guided by the guide rails and respectively accommodated in the first and second accommodation portions are provided respectively at the both side portions of the development cartridge.

16. A cartridge for an electrophotographic image forming apparatus having a body with an opening extending along a vertical plane substantially parallel to an external side of the body, the cartridge comprising:

a photoreceptor cartridge attached to, or detached from, the body through the opening, and comprising a first handle and a mounting portion; and a development cartridge comprising a second handle and attached to, or detached from, the mounting portion through the opening in a state where the photoreceptor cartridge is mounted in the body, wherein the second handle protrudes further towards the opening than the first handle.

* * * * *

UNITED STATES PATENT AND TRADEMARK OFFICE

CERTIFICATE OF CORRECTION

PATENT NO. : 9,104,169 B2
APPLICATION NO. : 14/021518
DATED : August 11, 2015
INVENTOR(S) : Ho-jin Jang et al.

It is certified that error appears in the above-identified patent and that said Letters Patent is hereby corrected as shown below:

In the claims,

Claim 15, Column 12, Lines 49 - 54

Delete "a development cartridge attached to, or detached from, the mounting portion through the opening in a state where the photoreceptor cartridge is mounted in the body, and fixed to the
the mounting portion by being pressurized when a cover over the opening is closed,"

and insert --a development cartridge attached to, or detached from, the mounting portion through the opening in a state where the photoreceptor cartridge is mounted in the body, and fixed to the mounting portion by being pressurized when a cover over the opening is closed,--, therefor.

Signed and Sealed this
Twenty-fourth Day of November, 2015

Michelle K. Lee

Michelle K. Lee
*Director of the United States Patent and Trademark Office*